United States Patent [19]

Fradenburgh et al.

[11] Patent Number: 5,015,842

[45] Date of Patent: May 14, 1991

[54] HIGH DENSITY FIBER OPTIC DAMAGE DETECTION SYSTEM

[75] Inventors: Evan A. Fradenburgh, Fairfield; Robert Zincone, Norwalk, both of Conn.

[73] Assignee: United Technologies Corporation, East Hartford, Conn.

[21] Appl. No.: 359,993

[22] Filed: Jun. 1, 1989

[51] Int. Cl.[5] ..... H01J 5/16

[52] U.S. Cl. ..... 250/227.15; 340/550

[58] Field of Search ..... 250/227, 227.14, 227.15, 250/227.16; 340/550, 555

[56] References Cited

U.S. PATENT DOCUMENTS

| | | | |
|---|---|---|---|
| 3,365,568 | 1/1968 | Germen . | |
| 3,492,493 | 1/1970 | Herriott et al. . | |
| 3,572,891 | 3/1971 | Longenecker . | |
| 3,739,184 | 6/1973 | Katsumata et al. . | |
| 3,917,383 | 11/1975 | Cook et al. . | |
| 4,082,421 | 4/1978 | Auracher et al. . | |
| 4,162,397 | 7/1979 | Bucaro et al. . | |
| 4,232,385 | 11/1980 | Hara et al. . | |
| 4,319,951 | 3/1982 | Korbelak et al. . | |
| 4,341,439 | 7/1982 | Hodge . | |
| 4,359,262 | 11/1982 | Dolan . | |
| 4,383,729 | 5/1983 | Suzuki et al. . | |
| 4,403,152 | 9/1983 | Schmid et al. . | |
| 4,412,878 | 11/1983 | Guazzo . | |
| 4,427,263 | 1/1984 | Lagakos et al. . | |
| 4,449,210 | 5/1984 | Myer . | |
| 4,472,022 | 9/1984 | Bearcroft et al. . | |
| 4,477,725 | 10/1984 | Asawa et al. . | |
| 4,525,818 | 6/1985 | Cielo et al. . | |
| 4,530,078 | 7/1985 | Lagakos et al. . | |
| 4,541,685 | 9/1985 | Anderson . | |
| 4,558,308 | 12/1985 | Ciordinik et al. | 340/550 |
| 4,558,920 | 12/1985 | Newton et al. . | |
| 4,563,639 | 1/1986 | Langeac . | |
| 4,586,030 | 4/1986 | Klostermann | 250/227 |
| 4,588,255 | 5/1986 | Tur et al. . | |
| 4,600,310 | 7/1986 | Cramp et al. . | |
| 4,603,252 | 7/1986 | Malek et al. | 250/227 |
| 4,615,582 | 10/1986 | Lefevre et al. . | |
| 4,619,499 | 10/1928 | Gerber . | |
| 4,627,686 | 12/1986 | Szentesi . | |
| 4,629,318 | 12/1986 | Malek et al. | 250/227 T |
| 4,648,168 | 3/1987 | Nolf et al. . | |
| 4,650,280 | 3/1987 | Sedlmayr . | |
| 4,653,848 | 3/1987 | Kloots . | |
| 4,654,520 | 3/1987 | Griffiths . | |
| 4,676,485 | 6/1987 | Ciordinik et al. | 340/550 |
| 4,680,573 | 7/1987 | Ciordinik et al. | 340/550 |
| 4,772,092 | 9/1988 | Hofer et al. | 250/227 |
| 4,777,476 | 10/1988 | Dank | 340/550 |
| 4,781,056 | 11/1988 | Noel et al. | 250/227 |

FOREIGN PATENT DOCUMENTS 2124784 2/1984 United Kingdom .

*Primary Examiner*—David C. Nelms
*Assistant Examiner*—Que Tan Le
*Attorney, Agent, or Firm*—William J. Sapone

[57] ABSTRACT

Optical fibers are used for monitoring the structural integrity of space based or aircraft structures where prompt notification of damage is required to effect rapid repair and thereby maintain safety and operational reliability. A plurality of optical fibers are disposed in an X-Y relationship, with the fibers optimally placed in a pattern comprised of multiple path reversals which provides extensive area coverage with a minimum of fibers thus defining multiple zones wherein damage within a zone is determined by interruption of the light through the damaged fibers.

24 Claims, 7 Drawing Sheets

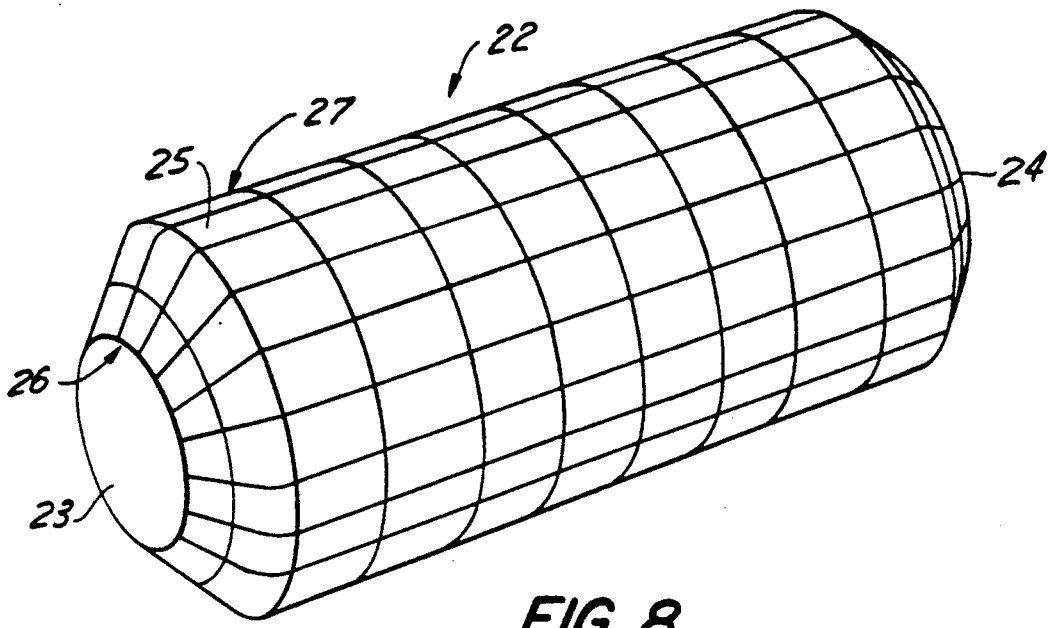
FIG. 8
FIG. 9
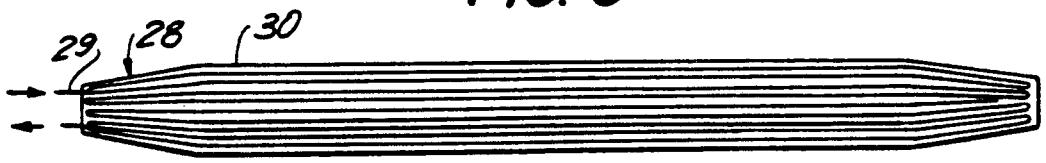
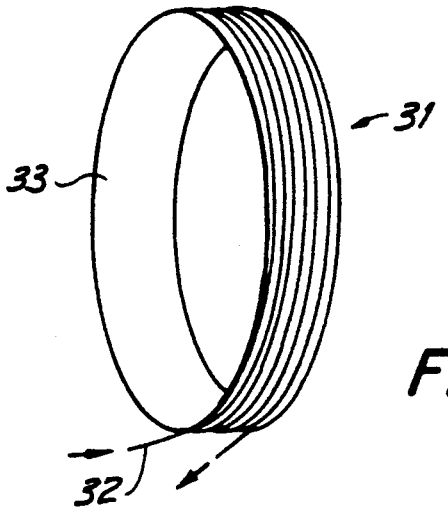
FIG. 10

HIGH DENSITY FIBER OPTIC DAMAGE DETECTION SYSTEM

TECHNICAL FIELD

This invention relates to damage detection systems, and more particularly to damage detection systems incorporating optical fibers embedded in or on composite structures.

BACKGROUND OF THE INVENTION

The use of composites for producing various structures is well known, particularly for aircraft, automotive or space applications. Composites have the advantage of high strength and low weight, reducing the energy requirements of automobiles and aircraft. For satellites or other space structures, composites reduce the lift requirements for placing these structures in orbit.

As presently envisioned, any future space station will include a plurality of pressurized structures integrated by interconnecting trusses, all composed of composite materials. Such large space structures as the pressurized modules will require a highly reliable structural monitoring system because of the potential vulnerability to micrometeor damage. Identification and prompt location of any puncture is required to maintain safety and operational reliability. However, there is no adequate system presently available for monitoring the structures and detecting sites of impact damage to allow rapid location and repair.

One method for damage detection involves closely spaced embedded optical fibers in an X-Y coordinate pattern. A plurality of single straight fiber optic strands are placed in a composite. Once a fiber is broken, light transmission is interrupted and the location of the damage determined. In large structures, however, if each adjacent strand in the fiber matrix is an individual fiber, independent from all of the rest, a substantial number of fibers are required. This, in turn, requires an automatic electronic readout system that is highly complex. In addition, the fiber bundles going in and out of the structure will be bulky and heavy. For example, one of the proposed space station modules has a structural surface area on the order of 2,500 square feet, comparable to a 50×50 foot square area. To detect a hole of ⅛" diameter anywhere in such a structure, a pattern of fibers with a ⅛" spacing would be required. An X and Y matrix to precisely locate the hole would require two sets of 4,800 fibers, each fiber 50-foot long and laid at right angles to each other for a total of 9,600 fibers. For automatic readout, an equal number of photo diodes to detect light transmission through the fibers from the source or a method of sequencing light input from the 9,600 fibers would be required. Such a system would be highly complex and prohibitive in terms of cost and weight.

Another application for a damage detection system is in composite aircraft structures subject to high stress where crack detection or impact damage detection is critical to aircraft survival. For such aircraft applications, the damage detection system must be of minimum complexity and weight to prevent a reduction in aircraft performance. Therefore, the straight X-Y fiber grid system would be unsuitable.

SUMMARY OF THE INVENTION

It is an object of the present invention to provide a damage detection system which can be produced integrally with composite structures.

It is another object of the present invention to provide a damage detection system which provides quick location of damaged areas without requiring an excessively complex monitoring system.

It is a further object of the present invention to provide a damage detection system which utilizes fiber optic strands embedded in composite structures for locating foreign object damage.

It is yet another object of the present invention to provide a fiber optic damage detection system which optimizes the number of fibers required for a given surface area.

According to the present invention, a fiber optic damage detection system includes a plurality of optical fibers placed on or embedded in a composite matrix. The optical fibers are arranged to monitor a substantial area, utilizing a particular pattern to optimize area coverage. The pattern includes a first number of optical fibers oriented in a loop pattern in a particular direction and a second set of optical fibers oriented in a crossing pattern with each crossover point defining a given area such that an impact strike in one of the areas will upset two particular fibers and therefore pinpoint the location of damage within a defined area.

In another embodiment of the present invention, the optical fibers are utilized in a loop pattern where a fiber is alternately looped forwardly and rearwardly, to increase fiber density per unit area, while maximizing bending radius, and therefore maintain optimal optical and structural integrity.

Utilizing a particular pattern of optical fibers placed on or embedded in a composite structure provides rapid determination of the impact damage location. In addition, such patterns minimize the number of fibers required, reducing the complexity of the signal generation, monitoring and locating apparatus.

BRIEF DESCRIPTION OF THE DRAWINGS

FIG. 8 shows another pattern according to the present invention usable on cylindrical structures including conical ends.

FIG. 9 shows one longitudinal band of fibers which may be prefabricated on a thin layer of composite or adhesive prior to application to a structure.

FIG. 10 shows a typical circumferential band which may be fabricated by winding a helical pattern directly on a structure.

DETAILED DESCRIPTION OF THE PREFERRED EMBODIMENT

The damage detection system of the present invention utilizes conventional optical fibers such as those produced by Spectran Corp, Sturbridge, Mass., or Corning Glass, Houghton Park, N.Y. Generally such fibers are about 140 microns in diameter, including an outer coating protecting a glass shaft with a core through which the light signal passes. It is contemplated that this damage detection system could be used with any composite system, such as a glass, graphite or polyaramid fiber reinforced composite systems using a wide range of resins. Thus, the invention is not limited by the type of composite chosen.

Figure 1:
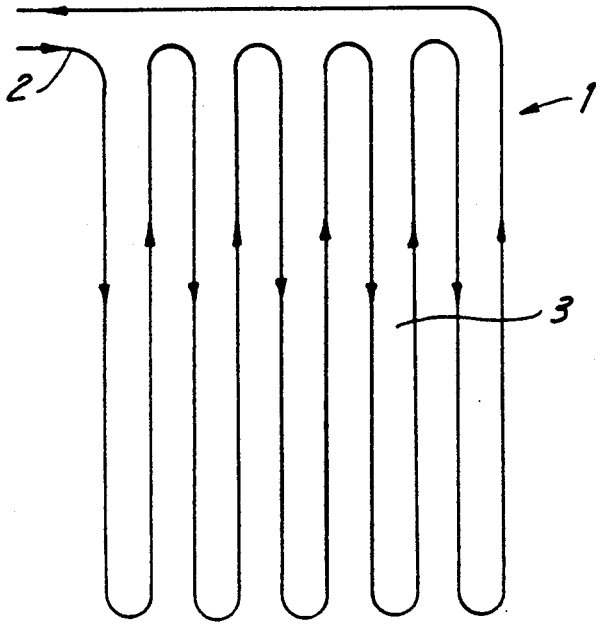
FIG. 1 is an area pattern usable with a single optical fiber.

Referring to FIG. 1, a simple looping pattern 1 for a single optical fiber 2 is shown which provides area coverage, with the optical fiber arranged to monitor a substantial area rather than a long narrow strip. The fiber 2 is looped with a tight radius, with a single fiber assigned to a single specific area 3, bounded by the dotted lines. For example, one fiber could be looped in a pattern constrained within one square foot of surface area, pinpointing damage within that one square foot. However, such an arrangement may involve an excessive number of fiber inputs and outputs for large structures.

Figure 2:
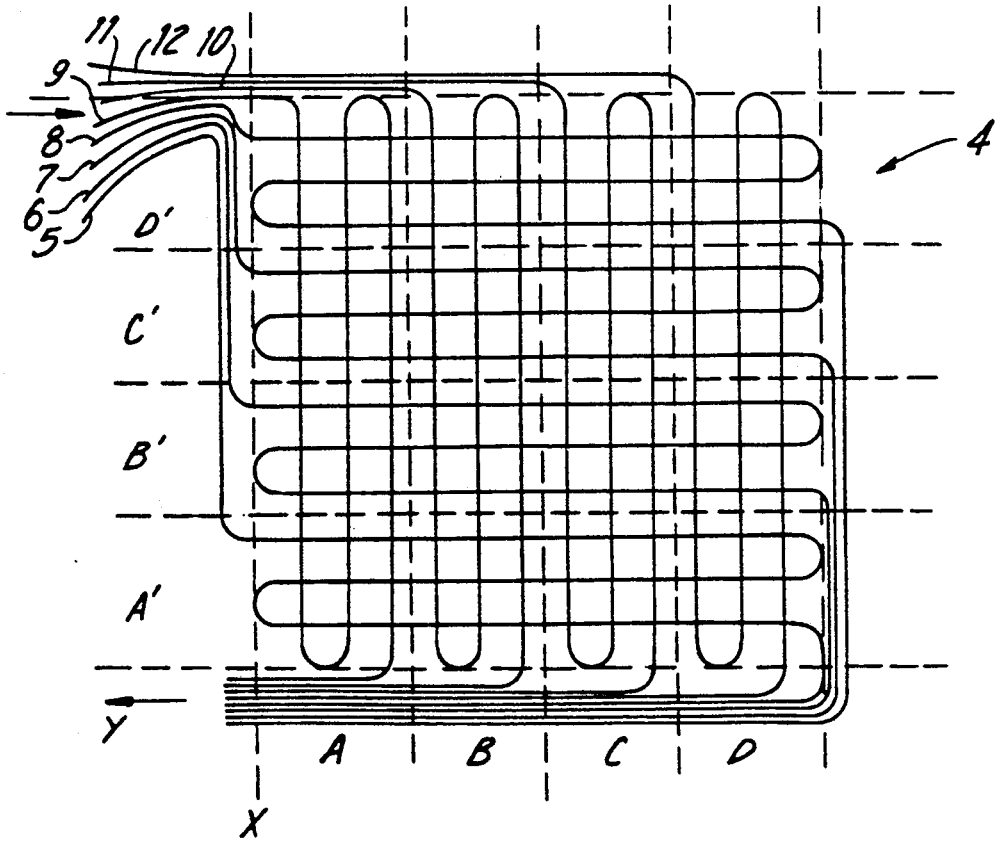
FIG. 2 is an illustration of an X-Y looping pattern, including a plurality of fibers arranged to provide optimum area coverage.

Referring to FIG. 2, an X-Y grid pattern 4 is shown which may be used in combination with the area coverage concept disclosed in FIG. 1. Eight fibers, 5–12 respectively, are used. Four optical fibers are looped in the X direction (5–8) and four optical fibers are looped in the Y directions (9–12), with each looped fiber providing the equivalent of three individual fibers. While only eight optical fibers are used, 16 zones are defined, shown by the dotted lines, each zone divided into a number of smaller local areas by the crossing fibers. Damage as small as 1/144 of the total area is detected and positively located within one of the 16 zones defined by the X-Y coordinates.

Referring still to FIG. 2, the X axis is defined as A, B, C and D, and the Y axis defined as A′, B′, C′ and D′, with each zone denoted as A-A′, A-B′, B-A′, C-B′, etc. Each zone includes two distinct fibers passing therethrough. For example, with the 8-fiber pattern of FIG. 2, the fibers numbered from 5–12, it is seen that damage in a zone, such as C-B′, will interrupt light transmission through 2 fibers, 6 and 10, pinpointing the damage for repair.

Figure 3:
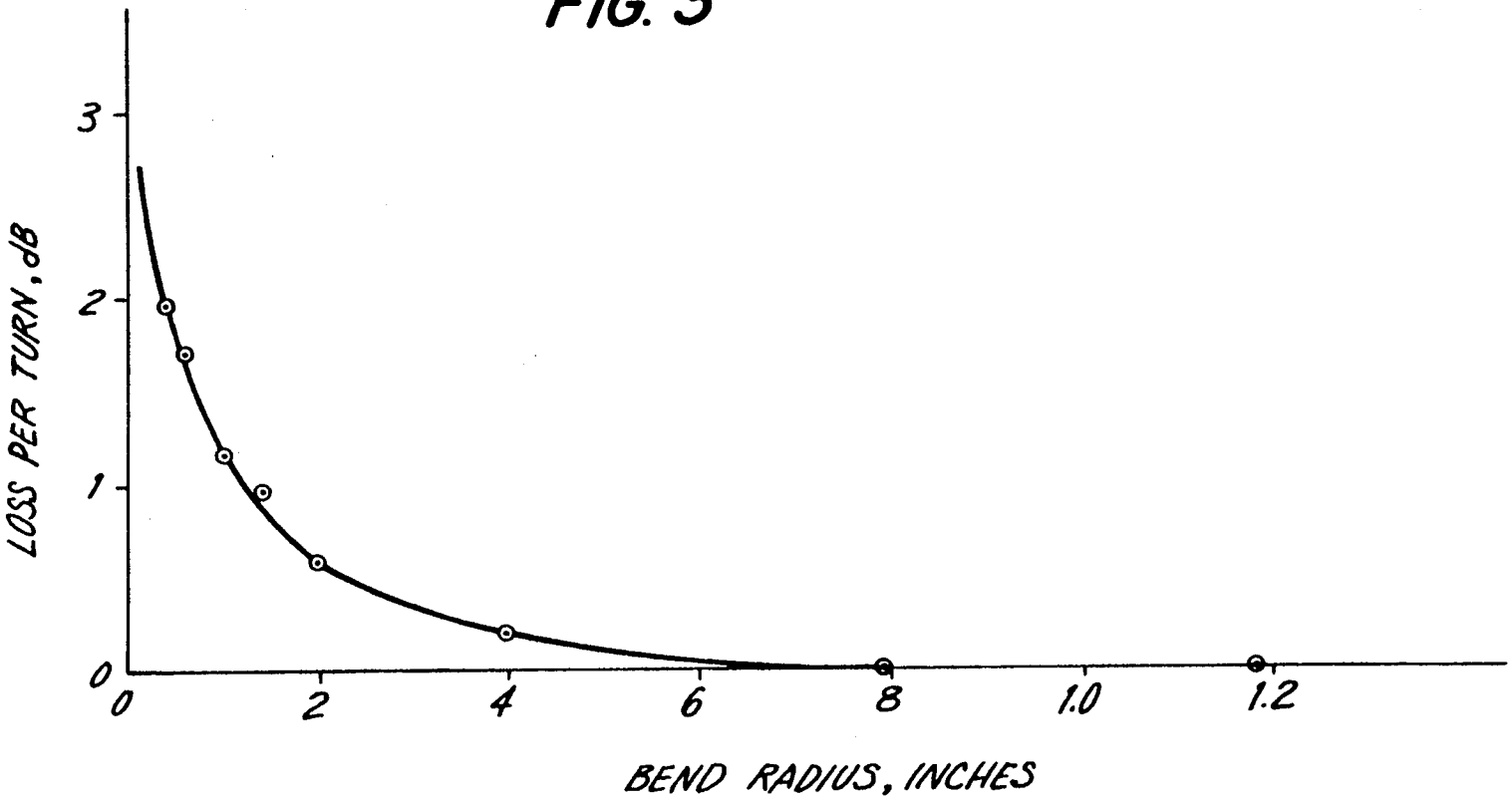
FIG. 3 is an illustration of transmission loss versus bend radius for an optical fiber.

The looping reversal patterns of FIGS. 1 and 2 do have limitations due to constraints on the bend radius of optical fibers. If very close spacing is desired, about $\frac{1}{8}$ inch, the fibers are prone to breakage in the bend and they will also be hard to place during composite manufacture because of the tendency to spring back. Referring to FIG. 3, it is also shown that transmission losses increase as radius decreases. For a bend radius of about $\frac{1}{4}''$, for example, the transmission loss per turn is about 1 db for a typical high quality optical fiber. While this may be acceptable for a few turning radii, where many loops are envisioned, such a transmission loss is unacceptable.

Figure 4:
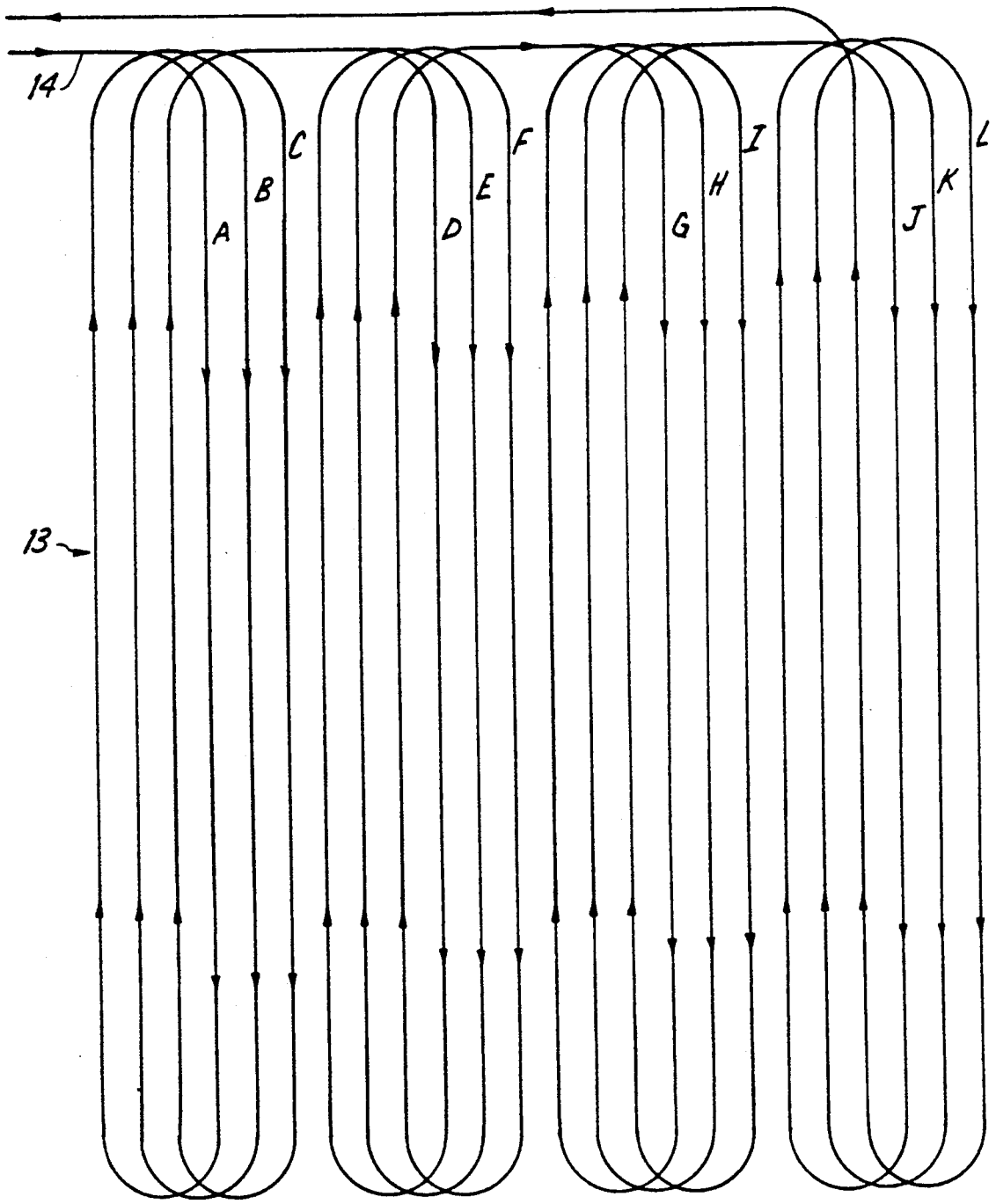
FIG. 4 shows an alternative embodiment of the fiber optic detection system of the present invention including a three-loop path reversal pattern wherein the fiber loops rearward as well as forwards.

Referring to FIG. 4, a pattern is shown which overcomes this transmission loss. FIG. 4 shows a three-loop path reversal pattern 13 wherein a fiber 14 loops rearward as well as forward. The fiber 14 follows, in downward sequence A–L, going down A, back three units at the bottom of FIG. 4, then four units forward at the top to go down B, back three, forward four to go down C, back three, then forward seven to go down D and start another cycle. The cycle then repeats through loop L. This cycle, of course, could be repeated for a number of cycles. FIG. 4 shows four cycles which provides six parallel fiber runs per cycle, for a total of 24 runs. The important feature of this pattern is that the fiber bend radius for the reverses is increased by a factor of 3 compared to the FIG. 1 and 2 patterns and a bend radius for the upper reverses is increased by a factor of 4. For a run spacing of $\frac{1}{4}''$, this provides acceptable bend characteristics for typical optical fibers, reducing transmission losses while easing incorporation in a composite and reducing the potential for breakage.

This pattern would similarly be utilized in an X-Y type grid, as shown in FIG. 2, with a number of fibers patterned as shown in FIG. 4 placed in the X direction, and a number of fibers similarly patterned in the Y direction. Thus, a plurality of distinct zones are defined, with the density of optical fibers within each zone increased. Utilizing the described pattern in an X-Y grid increases the monitoring density while reducing transmission losses and easing incorporation in a composite structure.

Figure 5:
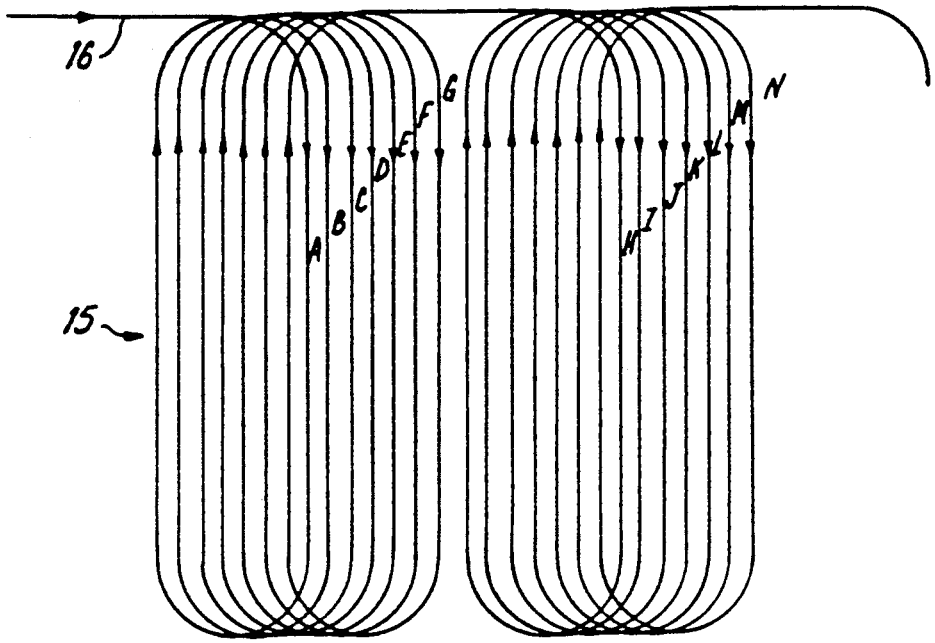
FIG. 5 shows another embodiment illustrating two cycles of a seven-loop optical fiber pattern.

For closer spacing, additional loops can be used. For example, referring to FIG. 5, two cycles of a seven-loop path reversal pattern 15 are shown. A fiber 16 enters the area, with the fiber going back seven units and forward eight until the pattern is complete (downward paths A–G) then forward 15 units to start the next cycle (paths H–N). Suitably large bend radii are achieved despite the close spacing of adjacent fibers. This pattern is suitable for covering large surface areas with high fiber density, yet using a minimum number of fibers. For a 50-foot square, 1-foot wide bands, 50-feet long, may be generated with the single optical fiber looped as described. For a $\frac{1}{8}''$ fiber spacing, a total of 96 vertical fiber runs are required per foot. Total fiber length is approximately $96 \times 50 = 4{,}800$ feet. In a good quality optical fiber, the transmission loss is quite low at this length. Fifty similar bands in each of the X and Y directions would define 2,500 zones, with damage as small as a $\frac{1}{8}''$ diameter hole detected and located in one of the 2,500 zones. The total number of individual fibers required is only 100, which allows the electro/optical monitoring system to be small, lightweight, reliable and inexpensive.

Figure 6:
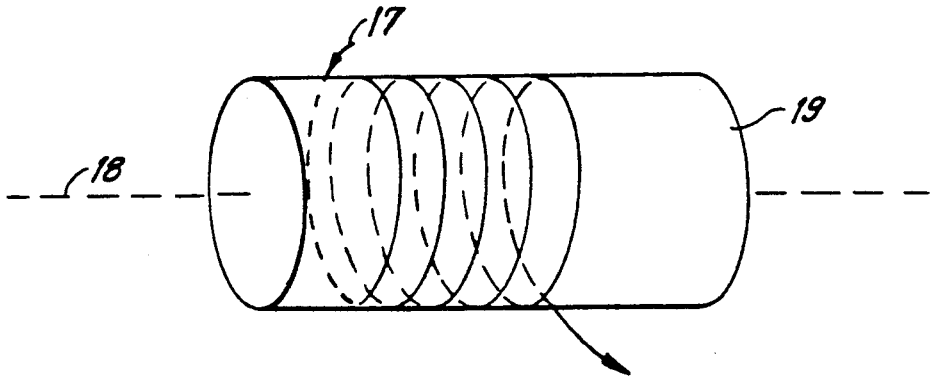
FIG. 6 shows another embodiment of the present invention, including an area pattern usable on cylindrical structures.

In another embodiment, the present invention is usable on cylindrical structures. Referring to FIG. 6, an optical fiber 17 is placed transverse to an axis 18 of a cylinder 19, in a continuous helical pattern which avoids any fiber bends. For example, in a truss structure, such as that proposed for the NASA space station, it is desired to detect damage on any tubular strut of the truss yet it is not required to precisely locate the damage on that strut as the consequences of such damages are not as critical as those involved in a structure such as a pressurized module housing living quarters. Thus, an X-Y type of grid is not needed, and a single fiber wound helically over the entire length of the truss may be used.

Figure 7:
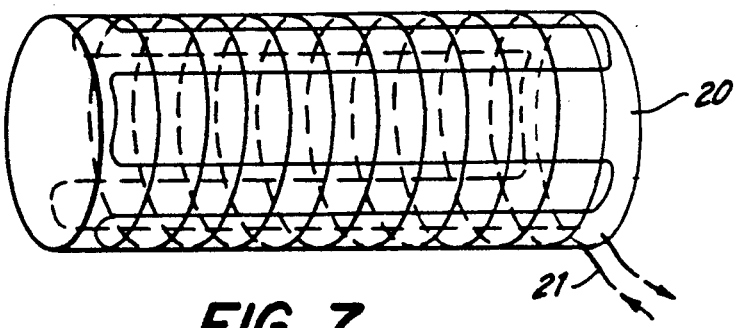
FIG. 7 shows another embodiment of the present invention, including an X-Y area pattern usable on cylindrical structures.

If additional structural integrity monitoring capability is desired, longitudinal elements may be included, as for example shown in FIG. 7. A cylinder 20 includes a single fiber 21 first wound helically therearound, and then wound in a loop pattern such as that shown in FIG. 1. In non-critical structures, a tight bend radius is not required, and a reversal pattern need not be used. Thus, fiber density per unit area is increased without increasing monitor complexity.

With cylindrical pressurized modules, it is necessary to include a more precise damage location system both on the cylindrical section and on the conical ends. One pattern which provides an X-Y type of damage location capability with a minimum of optical fibers is shown schematically in FIG. 8. A cylinder 22 having conical ends 23 and 24 includes area zones 25 defined by longitudinal bands 26 and circumferential bands 27, with the longitudinal bands extending from the cylindrical region to the conical ends. As previously shown, the X and Y fibers may be patterned in each band according to the patterns shown in FIGS. 1, 4 or 5 to increase sensitivity to damage while reducing transmission losses.

FIG. 9 shows a longitudinal band 28 as a preform, which may be prefabricated by placing a fiber 29 in a pattern (shown as a simple loop such as that shown in FIG. 1) on a thin layer of composite or adhesive 30. The band is then applied to either the surface of the structure, or incorporated as one layer in a multi-layer composite structure, where the adhesive holds the fibers in place during molding, preventing fiber movement during consolidation of the composite. Various adhesives could be used such as AF-13 film adhesive produced by the 3M Company. FIG. 10 shows a circumferential band 31, which is fabricated by winding a fiber 32 in a helical pattern directly onto a cylindrical structure 33. The circumferential band may be wound either over or under the longitudinal band.

The fiber optic leads into and out of the fiber optic network will generally be brought to a single conveniently located area to simplify the process of light introduction and collection for analysis. However, this tends to make the system vulnerable to damage in the areas where the fibers are bundled because damage in that area may sever numerous optical links, making it impossible to be sure in what bands or zones other damage occurred. In order to reduce the probability of a system failure, this vulnerable area can be held to a very small fraction of the total monitored area or be armored to reduce its vulnerability. However, this adds complexity and weight to the system. Another approach is to have a completely redundant fiber optic network overlapping the other network but with the input and output leads taking entirely different paths to a light input and collection point. While effective in locating damage, this substantially increases the number of fibers required, again adding weight and complexity to the system.

Figure 11:
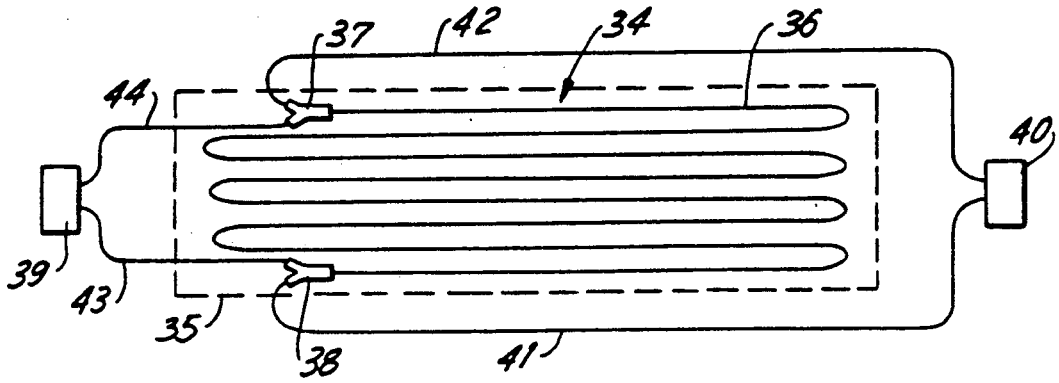
FIG. 11 shows a redundant input and output system for assuring continued operation should one set of input or output leads be damaged.

A preferred approach, illustrated in FIG. 11, is to have a single fiber optic network 34 but to use widely separated dual input and output leads. Referring to FIG. 11, the network 34 covers an area 35, bounded by the dotted line. A fiber 36 is placed in a pattern in the area 35, and has two Y-type optical couplers 37 and 38, attached at the beginning and end, respectively, of the fiber run. First and second input/output terminals, 39 and 40, are placed in separate locations, with the leads 41/42 (input) and 43/44 (output) taking separate paths to provide a redundant monitoring system. Thus, damage to one set of input or output leads will not affect operation of the network. The probability of both sets being damaged in a single occurrence is considered quite remote. Of course, any of the previously disclosed patterns can utilize this dual monitoring system.

Figure 12:
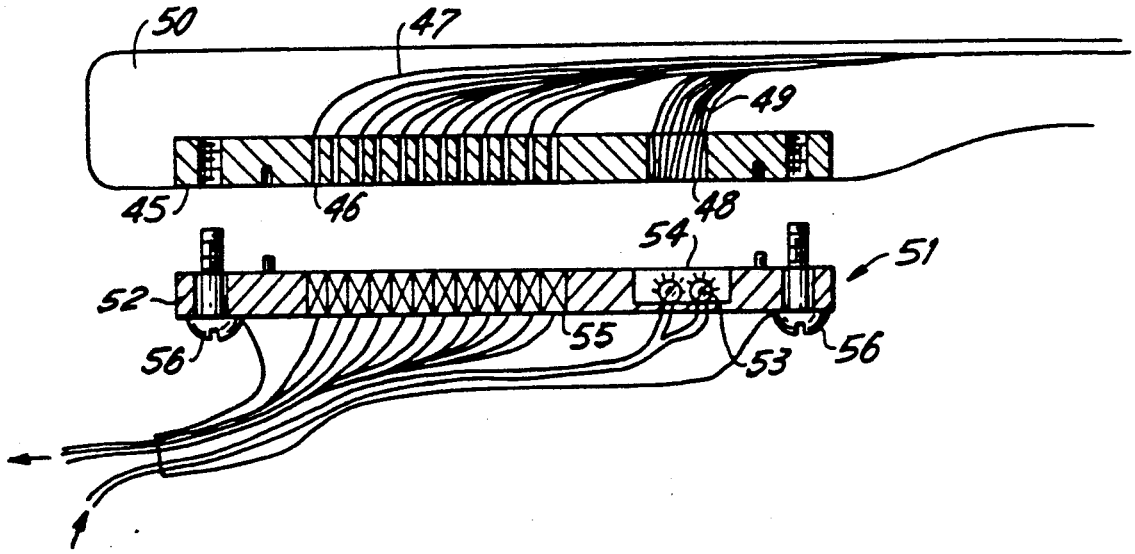
FIG. 12 shows a typical termination system for the optical fiber damage detection system of the present invention.

While various means for terminating the fibers may be used, the preferred termination of the optical fibers is shown in FIG. 12. Referring to FIG. 12, a first block 45, which may be made of metal or another suitable material, is prepared by drilling or otherwise providing a plurality of holes 46 through which individual fibers 47 are inserted. A hole 48 is also provided in the first block 45 for accommodating an opposite end of each fiber in a bundle 49. The first block 45 is inserted into a composite structure 50 during fabrication.

An electro/optic readout system 51 uses a mating block 52, containing pre-aligned light sources 53 in a chamber 54 corresponding to the bundle hole 48, and photo diodes 55 that interface with the optic fibers 47. The mating block is attached to the block 45 by screws 56 to integrate the network. The photo diodes 55 transform the light signals to an electrical impulse for monitoring by a computer or other monitoring means (not shown).

Figure 13A:
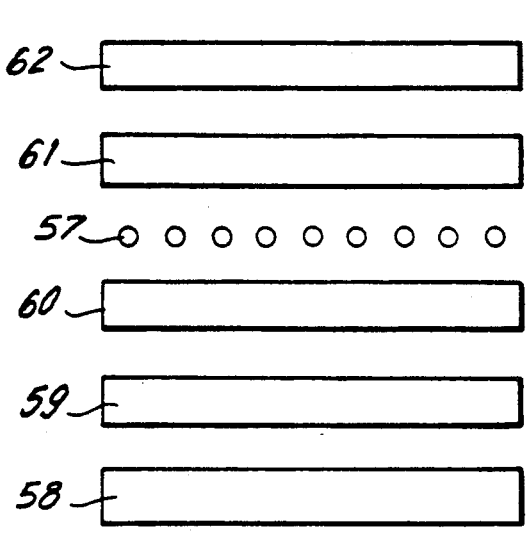
FIGS. 13A–C show the incorporation of the fiber optic damage detection system in a composite structure.
Figure 13B:
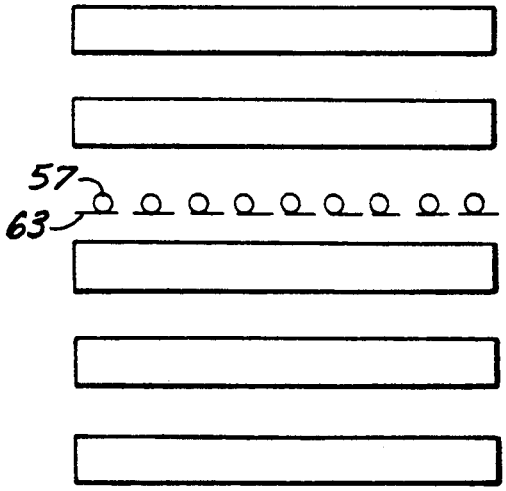
Figure 13C:
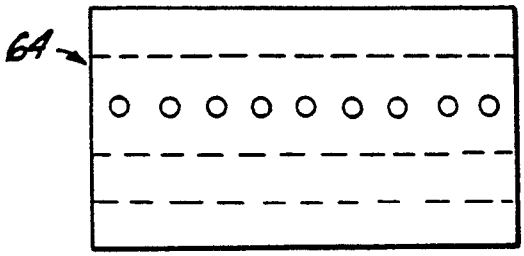

The optical fibers may be installed by lay-up as part of the composite structure which generally includes a plurality of resin preimpregnated layers or plies. Referring to FIGS. 13A–C, a fiber optic layer 57 is interposed with a plurality of structural layers, 58–62, respectively. Each structural layer may comprise resin preimpregnated fiberglass, polyaramid, graphite or other hybrid laminates. Of course, the number of layers will vary depending on the desired article. In FIG. 13A, the fiber layer 57 is placed on the structural layer 60, and then covered by the structural layer 61. After the desired number of structural layers is applied, the assembly is typically vacuum bagged to remove air, placed in an appropriate autoclaving device, heated under pressure and cured. FIG. 13B shows the use of a film adhesive 63 to hold the fiber layer, and FIG. 13C shows a consolidated and cured composite structure 64. Thus, the fiber network may comprise one layer embedded in the structure.

During the optical fiber installation, the fiber ends are routed through the predrilled block, with either the input or output fiber set routed in a prescribed sequence, through the predrilled holes, one fiber in each hole, with the other set bundled in random order through the larger predrilled hole. While the configuration shown in FIG. 12 corresponds to a bundled fiber input set and a prescribed output sequence, the reverse system could also be used. After fabrication and cure, the fiber ends are trimmed and polished flush with the surface of the predrilled block.

This arrangement provides that no fibers are routed outside of the structure and thus the fibers are relatively immune to accidental damage. In addition, the electro/optic readout system is easily replaced if a fault develops, and the fiber optic network system can be manually checked with ease whenever desired by removing the readout system mating block and using a hand-held light on the input fibers and visually inspecting the output array.

Utilizing the particular fiber networks described above allows relatively precise monitoring of structural integrity on sensitive systems such as cylindrical modules usable with a space station, aircraft cabin or wing structures. Such monitoring networks require a minimum of optical fibers while providing a maximum degree of protection. Utilizing the dual inputs and outputs described above additionally provides redundancy to the network without requiring a second redundant network superimposed thereover. In addition, due to the reduced number of fiber leads, the monitoring system can be reduced in complexity and size, saving weight and space while reducing the potential for failure.

While the above invention has been shown and described in relation to particular fiber optic patterns, it will be understood by those skilled in the art that various changes or modifications could be made without varying from the scope of the present invention. For example, the choice of composite material may be determined by the application and should not interfere with the practice of the invention.

We claim:

1. A fiber optic damage detection system for incorporation in a composite structure comprising a first fiber optic strand placed on or embedded in the structure in a pattern of multiple loops which define an area wherein loss of light transmission through the fiber indicates damage to that area, the fiber disposed in a multiple path reversal pattern, the pattern having loops in both the forward and rearward directions to increase the number of adjacent fiber runs in an area, to provide a high fiber density with a fiber spacing as close as ⅛", to detect damage with a minimum number of fibers and, means for monitoring light transmission through the fiber.

2. The detection system of claim 1 further comprising a second fiber optic strand placed on or embedded in the structure in a pattern of multiple loops, the second strand overlapping the first strand and patterned perpendicular thereto to provide an X-Y grid pattern defining a plurality of zones in the area to determine the existence and location of damage.

3. The detection system of claim 2 wherein the second fiber is placed on or embedded in the structure in a multiple path reversal pattern, the pattern having loops in both the forward and rearward directions to increase the number of adjacent perpendicular fiber runs.

4. The detection system of claim 2 wherein both the first and second fibers are placed on or embedded in the structure in a multiple path reversal pattern, the pattern having loops in both the forward and rearward directions to increase the total number of fiber runs in the area.

5. The detection system of claim 1 wherein the first fiber pattern has the fiber first looped back 3 rows then looped forward 4 rows, then moved forward 7 rows, looped back 3 rows and repeated.

6. The detection system of claim 3 wherein the second fiber pattern has the second fiber first looped back 3 rows then looped forward 4 rows, then moved forward 7 rows, looped back 3 rows and repeated.

7. The detection system of claim 1 wherein the first fiber pattern has the fiber looped back 7 rows, looped forward 8 rows, moved forward 15 rows then looped back 7 rows and repeated.

8. The detection system of claim 3 wherein the second fiber pattern has the fiber looped back 7 rows, looped forward 8 rows, moved forward 15 rows, looped back 7 rows and repeated.

9. A fiber optic damage detection system for a cylindrical structure, the system comprising a first optical fiber helically wound about the structure, the fiber wound about the structure to provide a high fiber density with a fiber spacing as close as ⅛", to detect damage to the structure, and, means for monitoring light transmission through the fiber.

10. The damage detection system of claim 9 wherein, at the end of the helical fiber run, the fiber is placed in a loop pattern perpendicular to the helical pattern.

11. The damage detection system of claim 9 further comprising a second optical fiber attached to the structure in a pattern comprised of multiple loops, the second fiber overlapping the first fiber and longitudinally positioned to produce an X-Y grid pattern defining a longitudinal band with a plurality of zones defined on the structure, to determine the existence and location of damage to the structure.

12. The damage detection system of claim 11 wherein the second fiber is attached to the structure in a multiple path reversal pattern, the pattern having loops in both the forward and rearward directions to increase the number of adjacent fiber runs.

13. The damage detection system of claim 12 wherein the second fiber pattern has the fiber first looped 3 rows then looped forward 4 rows, moved forward 7 rows, looped back 3 rows and repeated.

14. The damage detection system of claim 11 wherein the second fiber pattern has the fiber looped back 7 rows, looped forward 8 rows, moved forward 15 rows, looped back 7 rows and repeated.

15. The detection system of claim 1 wherein the fiber is adhesively attached to the structure.

16. The detection system of claim 1 wherein the fiber is embedded in the structure.

17. The detection system of claim 1 wherein the fiber has Y connectors at an input and an output end thereof.

18. The detection system of claim 17 wherein two leads are provided per Y connector, each lead taking a separate path to a separate monitoring means.

19. The detection system of claim 11 wherein a plurality of longitudinal bands are placed about the circumference of the structure.

20. The detection system of claim 19 wherein each longitudinal band is adhesively backed for incorporation in a composite structure.

21. A fiber optic damage detection system for incorporation in a composite structure comprising a first fiber optic strand placed on or embedded in the structure in a pattern of multiple loops which define an area wherein loss of light transmission through the fiber indicates damage to that area, the fiber disposed in a multiple path reversal pattern, the pattern having loops in both the forward and rearward directions to increase the number of adjacent fiber runs in an area, to provide a high fiber density with a minimum number of fibers and, means for monitoring light transmission through the fiber, and further comprising a terminal block having a plurality of holes, each hole having an end of a fiber therein, the block having a bundle hole for placing the opposite end of each fiber therein, the block being embedded in a composite structure.

22. The detection system of claim 21 further comprising a mating block having light generating means and light receiving means, configured for alignment with the fiber ends in the terminal block.

23. A composite structure formed from a plurality of structural layers, the structure having a fiber optic damage detection system incorporated therein, the damage detection system comprising a first fiber optic strand embedded in the structure between a pair of structural layers, the strand disposed in a pattern of multiple loops to provide a high fiber density with a fiber spacing as close as $\frac{1}{8}''$, which defines an area wherein loss of light transmission through the fiber indicates damage to that area.

24. A method for incorporating a fiber optic damage detection system in a composite structure formed from a plurality of structural layers, the method comprising:

placing a plurality of structural layers in a mold:

adding a first optical fiber strand on the structural layers in a pattern of multiple loops to provide a high fiber density with a fiber spacing as close as $\frac{1}{8}''$, which defines an area wherein loss of light transmission through the fiber indicates damage to that area;

placing additional structural layers on top of the optical fiber strand; and, consolidating and curing to form the composite structure.

* * * * *